US005362062A

United States Patent [19]

Schott

[11] Patent Number: 5,362,062

[45] Date of Patent: Nov. 8, 1994

[54] PILLOW FIGHT STRESS REDUCING GAME

[76] Inventor: Ted J. Schott, 7425 Bray Rd., Mount Morris, Mich. 48458

[21] Appl. No.: 229,381

[22] Filed: Apr. 18, 1994

[51] Int. Cl.[5] ..... A63F 3/00

[52] U.S. Cl. ..... 273/243

[58] Field of Search ..... 273/242, 243, 248, 249, 273/287, 288, 446, 451

[56] References Cited

U.S. PATENT DOCUMENTS

| | | | |
|---|---|---|---|
| 3,608,903 | 9/1971 | Cooper | 273/287 X |
| 3,623,728 | 11/1971 | Goldfarb | 273/109 |
| 3,708,168 | 1/1973 | Strader et al. | 273/287 X |
| 4,113,259 | 9/1978 | Sands | 273/241 |
| 4,344,625 | 8/1982 | Fudakis | 273/242 |
| 4,498,675 | 2/1985 | Jones | 273/287 X |
| 4,634,129 | 1/1987 | Martinez | 273/288 X |
| 4,671,514 | 6/1987 | Wilson-Diehl | 273/287 |
| 4,813,680 | 3/1989 | Rudell et al. | 273/249 |
| 4,966,371 | 10/1990 | Sherman | 273/243 |
| 4,971,561 | 11/1990 | Krane | 273/243 X |
| 5,067,723 | 11/1991 | Yurkovic | 273/249 |
| 5,251,904 | 10/1993 | Cruz | 273/243 |

*Primary Examiner*—William E. Stoll

*Attorney, Agent, or Firm*—Rhodes & Ascolillo

[57] ABSTRACT

A stress reducing game and apparatus for adults and children including a game board, with indicia defining a serpentine path formed of a series of contiguous colored blocks and colored tokens to be moved along the path as designated by the spin of a pointer. Further including instruction spaces along the path and neutral colors. Pillows are provided and players are allowed to swing the pillows at other players according to the rules. Each player begins at Start and moves along the path to Bedtime. The last player to reach Bedtime is the winner.

10 Claims, 3 Drawing Sheets

10

12
14
24
14
16
18
22
20
14
26
26
PILLOW FIGHT
MORTIMER SNERD
BOOP
MULTI-COLOR
BLACK
MOVE BACK TO OWN COLOR
PILLOW FIGHT
TIME OUT
PILLOW FIGHT
MULTI-COLOR
BLACK
PILLOW FIGHT
IME
BERTHA BLUEHAIR
SMACK
BAP
HARRY HITMAN
MULTI-COLOR

PILLOW FIGHT STRESS REDUCING GAME

BACKGROUND OF THE INVENTION

1. Field of the Invention

The invention relates generally to board games and more particularly to an active board game where the players move tokens along a path and according to the rules and instructions engage in some physical activity with the other players.

2. Description of the Prior Art

Although television seems to have taken over the minds and hearts of our children there is still some time and some place for the introduction of a game that is interesting, competitive and fun into their lives.

Board games are as old as humanity, however as long as man can think and he has idle time on his hands new games will continue to evolve. Some examples of more recent board games are shown by way of example in the following U.S. Patents; U.S. Pat. No. 4,113,259 issued Sep. 12, 1978 to Sands combines a game board with a path, spinning pointer, instructions and a water ejection system. U.S. Pat. No. 4,813,680 issued Mar. 21, 1989 to Rudell et al. teaches the combination of a water helmet game and a game board for score keeping. The U.S. Pat. No. 4,966,371 issued Oct. 30, 1990 to Chairman shows a game board with a path, instructions, cards the further instructions where movement is controlled by a toss of the dice. Yurkovic, discloses in her U.S. Pat. No. 5,067,723, issued Nov. 26, 1991 a board game with a path that provides instruction to the player via information printed on a path on the game board. U.S. Pat. No. 5,251,904 issued Oct. 12, 1993 to Cruz another board game that combines a path with instructions where the player is advanced along the path by the toss of a die and performs some activity as a result of some instruction indicated on the game board. The invention disclosed herein is clearly distinguishable over the U.S. Patents cited and all other games currently known to him.

SUMMARY OF THE INVENTION

The invention is for children or adults and is particularly designed to combine the anticipation and anxiety of game playing along with some physical activity which will tend to relieve stress and frustration. The equipment needed for the game consists of a game board having a serpentine path printed thereon. The board also includes a dial face and spinning pointer, to instruct players where to move tokens which represent players on the game board. Soft pillows are provided to allow players to pummel other players according to the instructions of the game. A timing device is provided to limit the time the players may engage in a pillow fight according to the rules. Optional equipment includes a helmet, elbow and knee pads for each player.

The game is played with two to six players. Each player picks a token having an identifying color. Spaces printed as part of the path have colors that are the same as the tokens as well as colors that are different, called neutral colors and spaces that are multi colored and spaces with no color. The dial face includes spaces with all colors included on the path. All players start from the same "Start" position. The first player spins the rotating pointer and moves his token to the color on the path that matches the color under the arrow when it comes to rest. The rules of the game allow for a number of options ranging from no activity to or from the player/players to an all out pillow fight engaging all players. The second and subsequent players follow the same procedure around the path until the player reaches the area marked "Bedtime" where the player loses, is soundly pummeled by the remaining players and is retired from the game. The winning player is the last remaining player on the path. Indicia printed on the board indicate where players sit while playing.

It is therefore an object of the invention to provide a new and improved board game that will reduce stress and frustration among the players.

It is another object of the invention to provide a new and improved board game that combines all the intellectual advantages of a game with the advantages of physical activity.

It is a further object of the invention to provide a new and improved game that will be enjoyed by adults as well as children.

It still another object of the invention to provide a new and improved method of playing a board game.

It is still a further object of the invention to provide a new and improved board game which is low in cost and of durable and reliable construction.

These and other advantages, features and objects of the invention will become more apparent from the following description taken in connection with the illustrative embodiment in the accompanying drawings.

DESCRIPTION OF THE PREFERRED EMBODIMENTS

Figure 1:
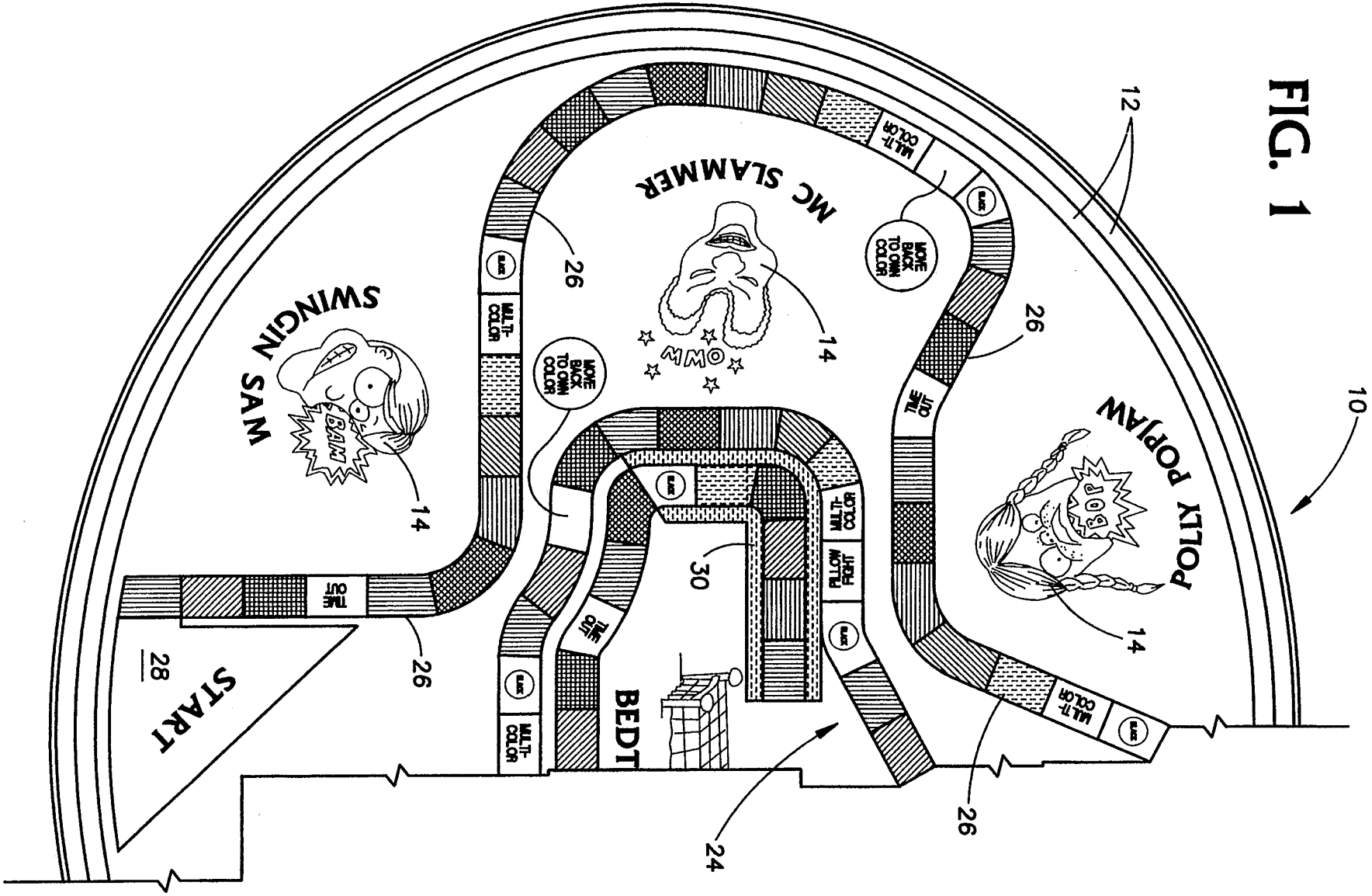
FIGS. 1 and 2 are a plan view of the game board of the invention.
Figure 2:
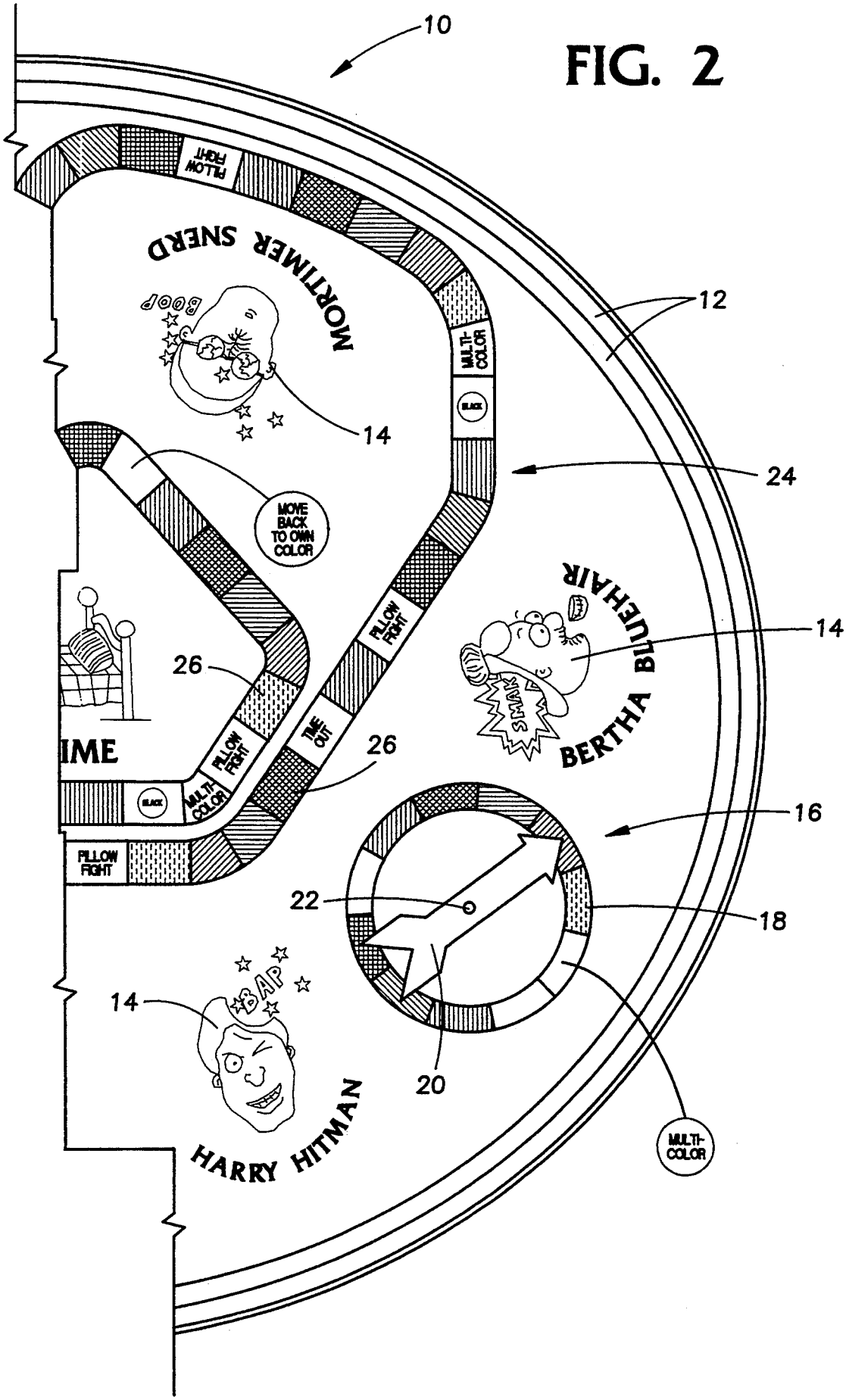

Referring now to FIGS. 1 and 2 there is shown a game board generally at 10 having a border 12. The board may be either circular or elliptical in shape in order supply sufficient space for the indicia printed on the board within the border. Randomly placed within the border are six characters heads 14 with playful names for example, Harry Hitman, Bertha Bluehair, Mortimer Snerd, Swingin Sam, McSlammer and Polly Popjaw. These characters add nothing to the game but identify a place for children to sit or kneel in order to maintain some order in a very activity filled contest. The board contains a dial face shown generally at 16 having a ring of blocks 18 colored according to the rules of the game. Spinning pointer 20 pivots about point 22 and rests over one of the blocks 18 thereby indicating to the player his next move. The board further contains a serpentine path shown generally at 24 containing a series of contiguous boxes 26 of a designated color, colors or containing instructional information according to the rules of the game. The path begins along the outside edge of the board in the start area 28. The path ends near the center of the board in the area labeled "Bedtime". The path is consistent in its design except for the final six boxes which are outlined in gray 30.

Figure 3:
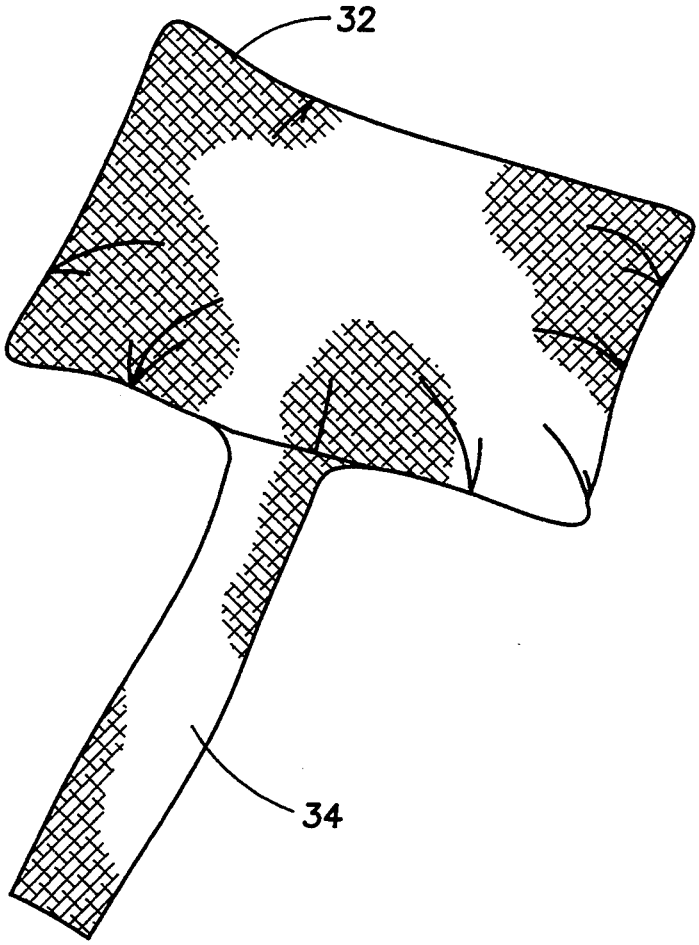
FIG. 3 is a perspective view of a pillow used in the invention.

FIG. 3 shows a rectangular pillow which may be filled with any conventional soft material normally used for pillow purposes. The same holds true for the handle 34 which will soften the blow of the pillow when use in a pillow fight.

Figure 4:
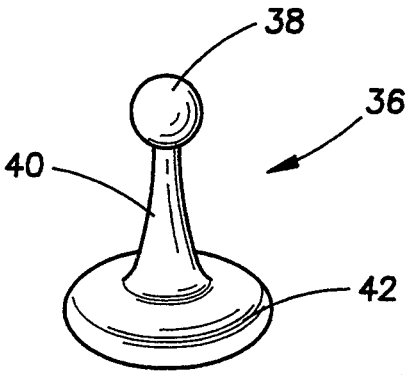
FIG. 4 is a perspective view of a token used in the invention.

FIG. 4 shows the token of choice generally at 36. The token may be manufactured from plastic or other like material. The token having the shape of a sphere 38 atop the frustum of a cone 40 which is mounted centrally on cylindrically shaped disc 42.

Figure 5:
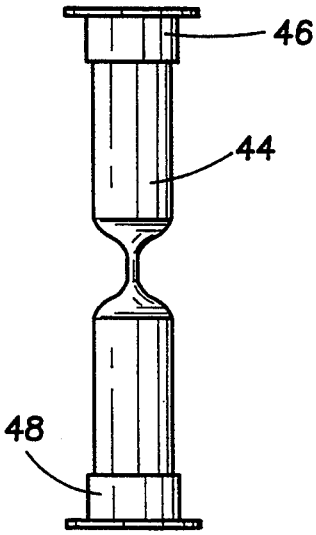
FIG. 5 is a side elevation view of the timer used in the invention.

FIG. 5 illustrates a typical timer that could be used with the invention. The hour-glass shaped timer 44 is equipped with ends 46 and 48 and filled with sufficient sand or other suitable material to time approximately forty five seconds.

The game is played with two to six players. The players are identified by a token of a specific color. Token colors are: red, black, green, purple, yellow and blue. These colors coordinate with colored blocks making up the path between "Start" and "Bedtime". The game begins with each player in turn spinning the pointer and moving his token to the first appropriate place on the path as indicated by the color over which the pointer comes to rest. Landing on the color of another player allows the player landing to swing his pillow at the player of the block color. If the pointer comes to rest over the spinning players own color all other players are allowed to swing their pillows at him. The player is then allowed to move his token back toward "Start" to the next space having his own color. Since the object of the game is to be the last player to reach "Bedtime" any move toward "Start" is beneficial to that player. Upon reaching "Bedtime" a player is allowed to be pummeled with pillows by all other players remaining in the game.

The dial face for the spinning pointer contains several colors and blank spaces in addition to the players colors. The colors are called neutral (orange, pink and brown) and no one is allowed to swing their pillow at another player. The blank spaces refer to instruction spaces on the path and the player must follow the instruction on the nearest forward space. The three instruction spaces are: "Time out" which means lose one turn; "Pillow fight" which lasts up to forty five seconds as measures by the games timer and "Move to your closest color behind you". The dial face also contains a multi-color block which is represented on the path and according to the ruled is a free shot space where the player moves his token then has the opportunity to swing his pillow at the player of his choice.

Once a player reaches the last six spaces along the path and as shaded in gray each player must spin his own color before he can land in "Bedtime".

Other rules that might be applied, would prohibit crying or penalize players for swinging pillows out of turn by requiring them to move their token forward an increasing number of spaces for each event.

Although the invention has been described with reference to a particular embodiment it will be understood to those skilled in the art that the invention is capable of a variety of alternative embodiments within the spirit and scope of the appended claims.

What is claimed is:

1. A game apparatus comprising: a circular game board including, a series of contiguous markings defining a serpentine path, printed thereon, the path beginning at an area designated as the starting point and ending at an area designated as bedtime; said path containing a plurality of spaces identified by a color; a plurality of spaces containing instructions and a plurality of spaces identified by multiple colors; position indicator means comprising a dial face divided into a plurality of color segments and rotatably disposed thereon a spinning pointer; a plurality of token means, each having a different identifying color, said colors matching the colors on the path and dial face, and pillows shaped to allow players to swing at other players according to the rules of the game.

2. A game apparatus according to claim 1 further including: timing means for timing selected events of the game.

3. A game apparatus according to claim 2 wherein: said timing means is an hour glass.

4. A game apparatus according to claim 1 wherein: the pillows include a flexible handle attached to a rectangularly shaped pillow body.

5. A game apparatus according to claim 1 wherein: the token means comprises, a solid sphere positioned on the frustum of a cone, further positioned centrally on a cylindrically shaped disk and formed as a solid structure.

6. A method of game playing by a plurality of players, utilizing a game apparatus having printed markings defining a serpentine path, where said path contains a plurality of spaces identified by color, a plurality of spaces containing instructions and a plurality of spaces identified by multiple colors; a dial face divided into a plurality of color segments, and rotatably disposed thereon a spinning pointer; token means matching the colors on the path and dial face: timer means, and pillows adapted to allow players to swing at each other comprising the steps of: each player selecting a token of a particular color; each player in turn spinning the pointer; moving the token to the color identified when the pointer comes to rest and swinging a pillow at the player whose color token is identified by the pointer; remaining players delivering pillow swings to the pointer spinning player when the pointer identifies the players own color; moving the token progressively along the path until the player reaches the space identified as bedtime when the players remaining in the game swing their pillows at that player and he is retired from the game; the last token on the board is the winner; the final six spaces of the path may only be traversed when the player spins his own color.

7. A method of game playing according to claim 6 including the step of: moving the token to a space containing instructions and following the instruction.

8. A method of game playing according to claim 7 including the step of: following the instruction of losing a turn.

9. A method of game playing according to claim 7 including the step of: following the instruction of pillow fight and timing said fight.

10. A method of game playing according to claim 7 including the step of: following the instruction of moving backward on the path to the next color space.

* * * * *